United States Patent [19]

Abthoff et al.

[11] 3,984,207

[45] Oct. 5, 1976

[54] MOUNTING SUPPORT FOR A CATALYST BODY

[75] Inventors: Jörg Abthoff, Pluderhausen; Hans-Dieter Schuster, Grossheppach; Rolf Gabler, Waiblingen; Gustav Felgendreher, Stuttgart, all of Germany

[73] Assignee: Daimler-Benz Aktiengesellschaft, Stuttgart, Germany

[22] Filed: Sept. 19, 1973

[21] Appl. No.: 398,792

[30] Foreign Application Priority Data

Sept. 23, 1972 Germany ..... 2246780

[52] U.S. Cl. ..... 23/288 F; 23/288 FC; 60/299

[51] Int. Cl.[2] ..... F01N 3/15; F01N 7/00; F01N 7/14; F01N 7/16

[58] Field of Search ..... 23/288 F, 288 FC; 60/322, 299

[56] References Cited

UNITED STATES PATENTS

| | | | |
|---|---|---|---|
| 1,716,479 | 6/1929 | Bilsky | 23/288 F UX |
| 2,038,567 | 4/1930 | Ittner | 23/288 F UX |
| 2,108,087 | 2/1938 | Thayer | 23/288 F |
| 2,611,238 | 9/1952 | Fryer | 60/322 |
| 2,850,365 | 9/1958 | Adey et al. | 23/288 F |
| 2,853,368 | 9/1958 | Adey | 23/288 F |
| 3,041,149 | 6/1962 | Houdry | 23/288 F |
| 3,169,836 | 2/1965 | Davis | 23/288 F |
| 3,441,381 | 4/1969 | Keith et al. | 23/288 FC |
| 3,645,092 | 2/1972 | Tatsutomi et al. | 60/322 |
| 3,653,205 | 4/1972 | Tadokoro | 60/322 |
| 3,692,497 | 9/1972 | Keith et al. | 23/288 FC |
| 3,722,221 | 3/1973 | Chopin et al. | 60/322 X |
| 3,754,870 | 8/1973 | Carnahan et al. | 23/288 FC |
| 3,768,982 | 10/1973 | Kitzner et al. | 23/288 F |
| 3,770,389 | 10/1973 | Kitzner et al. | 23/288 FC |
| 3,798,006 | 3/1974 | Balluff | 23/288 FC |
| 3,801,289 | 4/1974 | Wiley | 23/288 F |
| 3,817,714 | 6/1974 | Wiley | 23/288 F |
| 3,841,839 | 10/1974 | Wiley | 23/288 FC |
| 3,841,842 | 10/1974 | Wiley | 23/288 FC |
| 3,852,042 | 12/1974 | Wagner | 23/288 FC |
| 3,854,888 | 12/1974 | Frietzsche et al. | 23/288 FC |

*Primary Examiner*—Morris O. Wolk
*Assistant Examiner*—Bradley R. Garris
*Attorney, Agent, or Firm*—Craig & Antonelli

[57] ABSTRACT

A mounting support for a catalyst body which is adapted to be installed into an exhaust gas line of an internal combustion engine; the forces necessary for fixing the catalyst body which act in the longitudinal direction are thereby produced by walls of the mounting support which are located in front of and/or to the rear of the catalyst body, as viewed in the longitudinal direction of the mounting support, on that side on which the forces act laterally on the catalyst body; these walls support themselves at a distance from the catalyst body as measured in the longitudinal direction.

9 Claims, 2 Drawing Figures

MOUNTING SUPPORT FOR A CATALYST BODY

Figure 1:
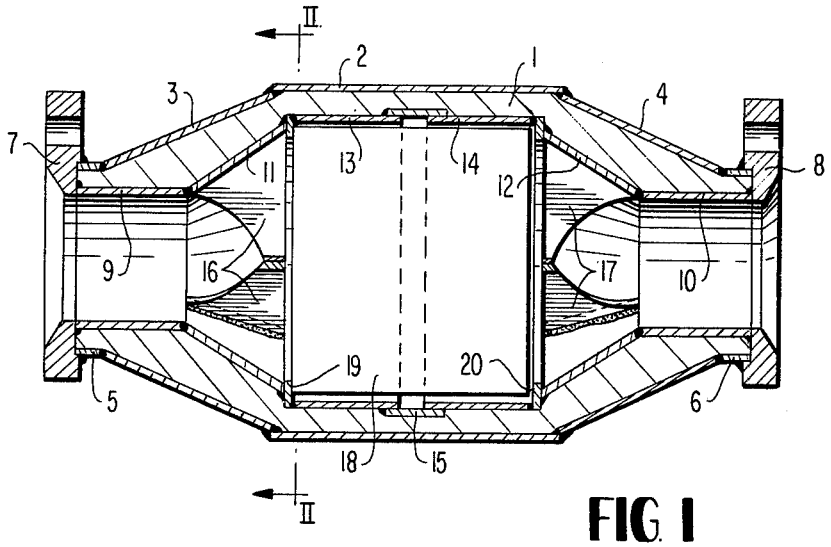

The present invention relates to a mounting support installed into an exhaust gas line of an internal combustion engine for a catalyst body carrying a catalyst material and traversed by the flow of the exhaust gases of the internal combustion engine, which is held fast by forces acting in the longitudinal direction of the mounting support.

A mounting support of this type is already known in the art, in which the same is constructed as pipe-shaped part into which is inserted the catalyst body of interposition of a wire mesh. The catalyst body is clamped fast in that two disks are pressed laterally against the catalyst body and are internally welded together with the pipe-shaped part. If during the operation of the internal combustion engine the mounting support and catalyst body warm up, then the pipe-shaped part together with the disks, customarily made from steel, expand more strongly than the catalyst body, customarily made of ceramic material. With the play between the disks and the catalyst body resulting therefrom, the catalyst body is thrown in rapid succession against the disks by reason of the pressure fluctuations of the exhaust gases so that it is rapidly destroyed and thereby becomes unusable.

The present invention is concerned with the task to provide a mounting support which is operable to clamp securely the catalyst body in every operating condition and prevents with certainty relative movements between the catalyst body and the mounting support.

The underlying problems are solved according to the present invention in that the forces for clamping the catalyst body are provided by walls of the mounting support which are disposed in front of and/or to the rear of the catalyst body in the longitudinal direction of the mounting support on that side on which they engage laterally at the catalyst body, and are supported with a spacing from the catalyst body as measured in the longitudinal direction.

By reason of the construction of the mounting support according to the present invention, the walls, during warm-up, press with increased force laterally against the catalyst body since they seek to expand themselves and thus seek to displace their engaging surfaces at the catalyst body toward one another. A play between the mounting support and the catalyst body can no longer occur. Also, the assembly of the catalyst body and of the mounting support is facilitated since, in the cold condition, only a relatively slight abutment pressure is necessitated.

In one advantageous embodiment of the present invention, the walls surround the catalyst body, whereby they overlap each other without any fixed connection therebetween. As a result thereof, a good gas seal toward the outside is attainable also in the area of the catalyst body without the need that forces are transmitted by this part of the walls.

A further favorable construction of the present invention results in that the mounting support is constructed double-walled and in that the walls applying the forces onto the catalyst body are the inner walls. As a result thereof, the different walls assume different tasks and more particularly, the inner walls assume the force transmission and the outer walls the sealing action toward the outside since the latter can be constructed without interruption over the entire length of the mounting support. Since by reason of the temperature drop within the space between the inner and outer walls, the inner walls seek to expand more strongly than the outer walls, also with this construction a rapidly increasing abutment force can be attained with increasing temperature. However, an approximate constancy of the abutment pressure can be achieved also by a suitable pre-determination of the temperature drop and a fixing of the lengths of outer and inner walls.

Furthermore, it is advantageous if the outer walls are supported at the adjoining parts of the exhaust line and the inner walls are supported at the same parts or in proximity thereto at the outer walls or if the inner and outer walls are supported at connecting parts of the mounting support. In both of the latter cases, the mounting support together with the catalyst body can be constructed and installed as structural unit. The forces occurring on the inside of the mounting support need not be transmitted to the remaining exhaust gas line.

A heat-insulating material may be disposed in the space between the inner and outer walls so that the temperature drop between the inner and outer walls and therewith the difference in their longitudinal expansion can be increased. The differing longitudinal expansion can also be influenced in that the material of the inner walls have a larger coefficient of thermal expansion than that of the outer walls.

Accordingly, it is an object of the present invention to provide a mounting support for a catalyst body adapted to be installed into an exhaust gas line of an internal combustion engine which avoids by simple means the aforementioned shortcomings and drawbacks encountered in the prior art.

Another object of the present invention resides in a mounting support for a catalyst body which assures a long length of life and eliminates the danger of rapid destruction due to the occurring pressure fluctuations in the exhaust gas system.

A further object of the present invention resides in a mounting support for a catalyst body which assures a secure clamping of the catalyst body under every operating condition while at the same time preventing relative movements between the same and the mounting support.

Still a further object of the present invention resides in a mounting support for a catalyst body adapted to be installed in the exhaust gas system of an internal combustion engine which eliminates the occurrence of a play between the mounting support and the catalyst body and which facilitates the assembly of the catalyst body and mounting support without sacrifice in the required abutment forces necessary to hold the catalyst body in place during the operation of the engine.

Still another object of the present invention resides in a mounting support of a catalyst body of the type described above which permits a good gas tightness toward the outside and a ready control of the abutment forces acting on the catalyst body under all temperatures occurring in operation.

Another object of the present invention resides in a mounting support for a catalyst body which permits the same to be installed as structural unit, thereby facilitating the assembly thereof.

Figure 2:
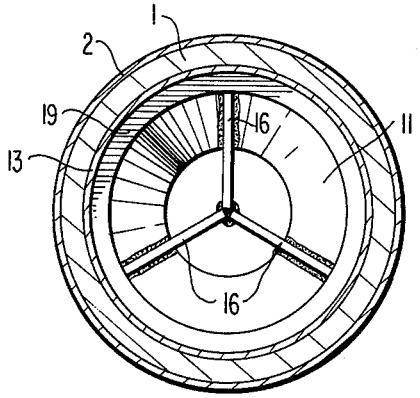

These and further objects, features and advantages of the present invention will become more apparent from the following description when taken in connection with the accompanying drawing which shows, for purposes of illustration only, one embodiment in accordance with the present invention, and wherein:

FIG. 1 is a longitudinal cross-sectional view through a mounting support with a catalyst body in accordance with the present invention; and FIG. 2 is a cross-sectional view through the mounting support taken along line II—II of FIG. 1.

Referring now to the drawing wherein like reference numerals are used throughout the two views to designate like parts, the mounting support of the present invention is constructed double-walled whereby an insulating material 1 of any conventional type is disposed in the space between the two jackets. The outer jacket essentially consists of a cylindrically shaped wall 2, of a truncated conically shaped wall 3 and 4 tapering outwardly which adjoins the cylindrically shaped wall on each side thereof and of a cylindrically shaped wall 5 and 6, again adjoining the truncated conically shaped walls 3 and 4, respectively. The walls 2 to 6 are welded together. The walls 5 and 6 are welded together with a respective connecting member 7 and 8 which is threadably connected, for example, by means of bolts with the adjoining parts (not shown) of the exhaust gas line.

The inner jacket of the mounting support essentially consists of two parts which are not rigidly connected with each other. Each part consists of a cylindrically shaped wall 9 and 10 welded together with a respective connecting member 7 and 8, which is adjoined by a respective wall 11 and 12 of truncated conical shape, which in turn is again adjoined by a cylindrically shaped wall 13 and 14, respectively. These two walls 13 and 14 extend close up to the center of the mounting support so that a spacing in the longitudinal direction of the mounting support remains preserved between the same. A tubular member 15 is externally welded to one end of the wall 13 which bridges the spacing and slides over a part of the wall 14 without being rigidly connected thereto. This tubular member 15 serves for sealing the space between the two jackets with respect to the interior of the mounting support without impairing a movement of the two walls 13 and 14 in the longitudinal direction. Three ribs 16 and 17 each, mutually displaced by 120°, are welded together with the two walls 11 and 12; the ribs 16 and 17 serve, on the one hand, for the reinforcement of the inner jacket and, on the other, for a good distribution of the exhaust gases which flow through the mounting support in the longitudinal direction.

A catalyst body 18 in the form of a cylindrical member is inserted into the space between the two walls 13 and 14. A large number of holes extend in the longitudinal direction through this catalyst body 18 of conventional construction and made from ceramic material, which are coated with a catalyst material of any known, conventional type. The catalyst body 18 is clamped-in between two disks 19 and 20 which are each welded together with the walls 11 and 13 as well as with the walls 12 and 14, respectively, at the transitions of the walls 11 and 13 as well as 12 and 14. The disks 19 and 20 abut at the flat sides of the catalyst body 18 in the radially outer area thereof. The disks 19 and 20 which are supported at the connecting members 7 and 8 by way of the walls 9 and 11 as well as the walls 10 and 12, exert already in the cold condition of the mounting support the abutment forces in the longitudinal direction of the mounting support which are necessary for fixing the catalyst body. If the mounting suppot now warms up as a result of the hot gases flowing therethrough, then the inner walls 9, 10, 11 and 12 seek together to expand by a larger amount than amounts the change in the distance between the two connecting members 7 and 8 which is determined by the longitudinal expansion of the outer walls 2, 3, 4, 5 and 6 since the inner walls 9, 10, 11 and 12 become considerably hotter than the outer walls 2, 3, 4, 5 and 6. As a result thereof, an increase of the abutment forces and thus also a still better fixing of the catalyst body 18 is achieved with a warm-up of the mounting support.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What we claim is:

1. A device for purifying the exhaust gas of an internal combustion engine comprising an outer housing; an inner housing within said outer housing, said inner housing composed at least of an upstream housing member rigidly secured with respect to an upstream portion of said outer housing and a downstream housing member rigidly secured with respect to a downstream portion of said outer housing, said upstream housing member and said downstream housing member axially overlapping one another, said inner housing forming a flow passageway for the flow of exhaust gas therethrough; and a fixed member within the passageway in said inner housing, said fixed member carrying a catalyst and defining upstream and downstream faces arranged perpendicular to the flow direction of exhaust gas through said flow passageway; said upstream and downstream housing members provided with clamping means in parallel planar abutment with said upstream and downstream faces for clamping said fixed member in said inner housing.

2. The device of claim 1, wherein the coefficient of thermal expansion of the material forming said inner housing is higher than the coefficient of thermal expansion of the material forming said outer housing.

3. The device of claim 1 further comprising thermal insulation between said outer housing and said inner housing.

4. The device of claim 1, wherein said upstream housing member is secured with respect to an upstream portion of said outer housing at a location axially spaced from said fixed member, and further wherein said downstream housing member is rigidly secured with respect to a downstream portion of said outer housing at a location axially spaced from said fixed member.

5. The device of claim 1, wherein said inner housing and said outer housing define a space therebetween, said device further including insulating means in said space.

6. The device of claim 1, wherein said housing members axially overlap one another without fixed connection in slip fitting relation.

7. The device of claim 1, wherein said outer housing and said inner housing are rigidly secured with respect to one another at lease on one axial side of said fixed member at an axial distance from said fixed member.

8. The device of claim 1 further comprising means for mounting said device on an exhaust pipe connected to an internal combustion engine, said outer housing fixedly attached to said mounting means, said inner housing being fixedly attached to said mounting means.

9. The device of claim 8 wherein said means for mounting comprises a first mounting element upstream of said fixed member and a second mounting element downstream of said fixed member, said outer housing being fixedly attached to both said first mounting element and said second mounting element, said inner housing being fixedly attached to both said first mounting element and said second mounting element.

* * * * *